United States Patent [19]

Schulz

[11] Patent Number: 4,539,448

[45] Date of Patent: Sep. 3, 1985

[54] DISCONNECT SWITCH FOR METAL-CLAD, PRESSURIZED-GAS INSULATED, HIGH-VOLTAGE SWITCHGEAR INSTALLATION

[75] Inventor: Winfried Schulz, Berlin, Fed. Rep. of Germany

[73] Assignee: Siemens Aktiengesellschaft, Berlin and Munich, Fed. Rep. of Germany

[21] Appl. No.: 646,434

[22] Filed: Aug. 30, 1984

[30] Foreign Application Priority Data

Sep. 1, 1983 [DE] Fed. Rep. of Germany ..... 3331819

[51] Int. Cl.[3] ..... H01H 33/16

[52] U.S. Cl. ..... 200/144 AP; 200/146 R; 200/148 D

[58] Field of Search ..... 200/144 AP, 146 R, 148 D

[56] References Cited

U.S. PATENT DOCUMENTS

| | | | |
|---|---|---|---|
| 2,811,613 | 10/1957 | Latour | 200/148 D |
| 4,086,461 | 4/1978 | Gonek | 200/144 AP |
| 4,296,288 | 10/1981 | Yanabu et al. | 200/146 R |
| 4,338,500 | 7/1982 | Pham Van et al. | 200/144 AP |
| 4,439,652 | 3/1984 | Beier | 200/146 R |
| 4,445,014 | 4/1984 | Gruner et al. | 200/146 R |

FOREIGN PATENT DOCUMENTS

| | | |
|---|---|---|
| 2406160 | 8/1974 | Fed. Rep. of Germany . |
| 2704389 | 3/1978 | Fed. Rep. of Germany . |
| 1514265 | 1/1967 | France . |

*Primary Examiner*—Robert S. Macon

*Attorney, Agent, or Firm*—F. W. Powers; J. L. James

[57] ABSTRACT

A disconnect switch is provided for a metal-clad, pressurized-gas insulated, high-voltage switchgear installation. The disconnect switch includes:

first and second contact assemblies which have a common longitudinal axis and are switchable between an open position and a closed position. An isolating tube is positioned inside one of the first contact assemblies and is movable therein along the axis during a switching operation between an open position at which the contact element is completely within the said one contact assembly and a closed position at which the said contact element engages the other contact assembly. First and second resistors are positioned within the isolating tube and are movable along the axis inside the isolating tube during switching toward and from the other of the contact assemblies.

The disconnect switch for a metal-clad, pressurized-gas insulated, high-voltage switchgear installation discourages generating of high frequency oscillations and arcing to the metal of the encapsulation during switching. The disconnect switch uses two resistors of equal size which move inside an isolating tube to make electrical contact prior to the main contacts and to break electrical contact after the main contacts. In this manner, the arc is encouraged to exist between the two resistors inside the isolating tube.

27 Claims, 7 Drawing Figures

DISCONNECT SWITCH FOR METAL-CLAD, PRESSURIZED-GAS INSULATED, HIGH-VOLTAGE SWITCHGEAR INSTALLATION

BACKGROUND OF THE INVENTION

The invention relates generally to a disconnect switch and more particularly to a disconnect switch for metal-clad, pressurized gas insulated, high voltage switchgear installations having 2 cylindrical contacts which may be surrounded by field electrodes and which connect to each other in the closed position, for which purpose at least one of the contacts is movable along a common longitudinal axis.

A disconnect switch is disclosed in GB Pat. No. 15 44 398 in which inside of one contact there is arranged a movable isolating tube, which, during the switching operation bridges the isolation space, when the contacts are moved. The isolating tube bridges the isolation space in an arc-impervious way, before one contact enters into galvanic contact with the opposite contact. Movement of the isolating tube ist effected by the mowement of the contact. This will prevent any preliminary arc discharge, between the contacts when still at a certain distance from one another, which might develop when switching the disconnect switch under voltage, from wandering during slow switch movements and from sparking over to the grounded metal housing. The isolating tube thus becomes a pre-arcing cage, bridging the isolation space, before arcing distance by the contacts is reached. At the return of the contact, the isolating tube leaves the isolation space only after the moving contact is within reach of the shielding electrode and no arcing is possible.

It is known for a disconnect switch, from French Pat. No. 1,514,265, to arrange a cylindrical resistance on the inside of the isolating housing surrounding the switching chamber. This resistance at one end is constantly in touch with one contact of the disconnect switch. The other end is connected to a contact rail running over a certain length on the inside of the insulating housing. The movable contact has an auxiliary contact that can slide on the contact rail. In the closed position of the disconnect switch, the auxiliary contact is lying on the contact rail in such a way that the resistance is in parallel to the contacts. This condition exists during the start of the opening movement of the movable contact until the auxiliary contact is leaving the contact rail. Based on the dimensions of the switch, this occurs only when the switching arc ist already extinguished. Then the resistance is no longer in parallel to the opened contacts. During the closing of this disconnect switch, the resistance again will be connected in parallel before the contacts touch.

It is known from U.S. Pat. No. 3,829,707 that high frequency oscillation can be generated during switching operations. Broad-band high frequency oscillations are generated in particular during switching of a disconnect switch with slow moving contacts within a pressurized-gas insulated, metal-clad, high-voltage switchgear installation. On the known metal-clad high-voltage circuit insulated with $SF_6$, these oscillations are considerably suppressed or damped because the conducting element is covered along at least a part of its length with a high frequency dampening layer. This layer opposes the high frequency oscillations without influencing the currents flowing underneath in the conductor material with a normal operating frequency.

The invention also concernes the problem of high frequency oscillation in pressurized-gas insulated, metal-clad, high-voltage switchgear installation. It was recognized that under certain conditions, the frequencies of some of these broad-band high frequency oscillations could be in resonance with the characteristic frequencies of a metal-clad high-voltage switchgear installation resulting from its own dimensions. In such a case, stationary waves are generated inside the metal-clad high-voltage switchgear installation, the local current maxima of which reduce the insulating strength so much that an arcing to the metal of the encapsulation can take place.

It is an object of this invention to provide a disconnect switch for a metal-clad, pressurized-gas insulated, high-voltage switchgear installation wherein arcing to the metal of the encapsulation does not occur.

It is also an object of this invention to provide a disconnect switch which is not susceptible to high frequency resonance oscillations which reduce insulating strength encouraging arcing to the metal of the encapsulation.

SUMMARY OF THE INVENTION

Briefly stated, in accordance with one aspect of the invention, a disconnect switch is provided for a metal-clad, pressurized gas insulated, high voltage switchgear installation. The switch includes first and second cylindrical contacts which have a common longitudinal axis and are switchable between an open position at which the contacts define an isolation space and a closed position at which the contacts are in electrical contact. Therefor at least one of the contacts is movable along the axis. An isolating tube is positioned inside of one of the contacts and is movable along the axis during switching. The isolating tube is bridging the isolation between the contacts as long as one of the contacts is moved. The disconnect switch includes first and second resistances which move along the axis during switching. Each resistance is of approximately the same size, and is electrically connected or connectable to one of the contacts. The resistances have external dimensions which are smaller than the internal diameter of the isolating tube.

By constructing the disconnect switch so that the first and second resistances make and break contact during switching prior to the closing or opening of the switch and only after the at least sufficient bridging of the isolations space by the isolating tube arcing between the resistances occurs inside the isolating tube. High frequency oscillations does not accur since the arc is drawn between the two resistances.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiments taken in conjunction with the accompanying drawings in which:

DETAILED DESCRIPTION OF THE PREFERRED EMBODIMENTS

Figure 3:
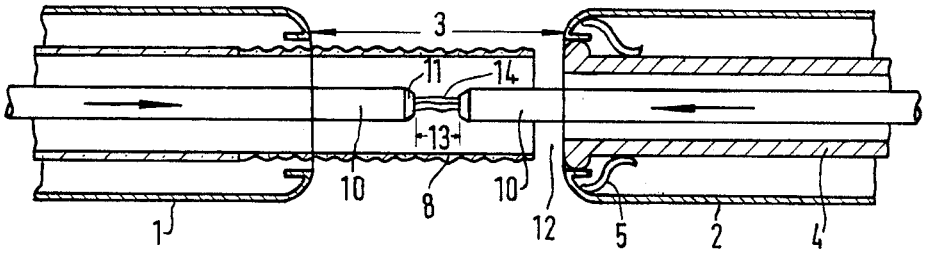
FIG. 3 is a view similar to FIG. 2 but showing the switch as an arc is drawn between the resistors inside the isolating tube.
Figure 4:
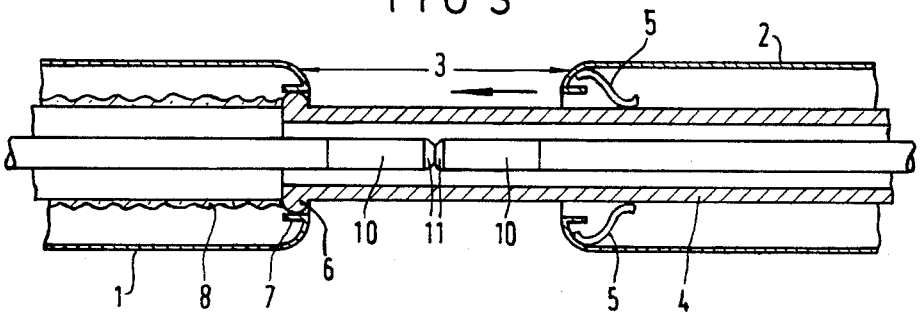
FIG. 4 is a view similar to FIG. 3 but showing the switch in the closed-circuit position.
Figure 5:
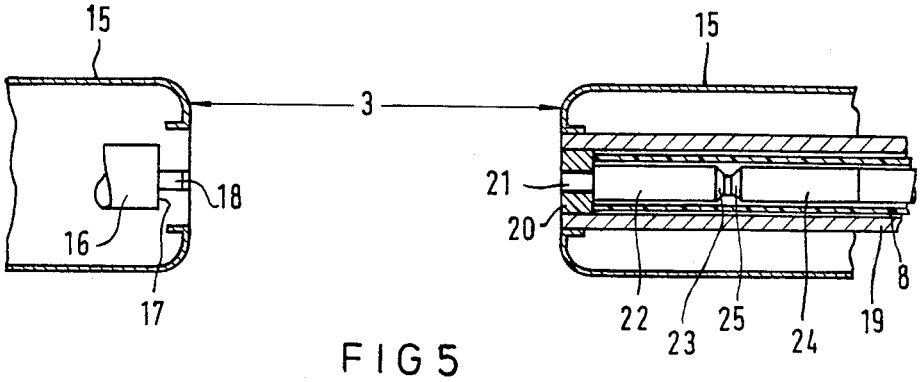
FIG. 5 is a diagrammatic longitudinal cross-sectional view of another embodiment of a disconnect switch showing the switch in the open-circuit position.
Figure 6:
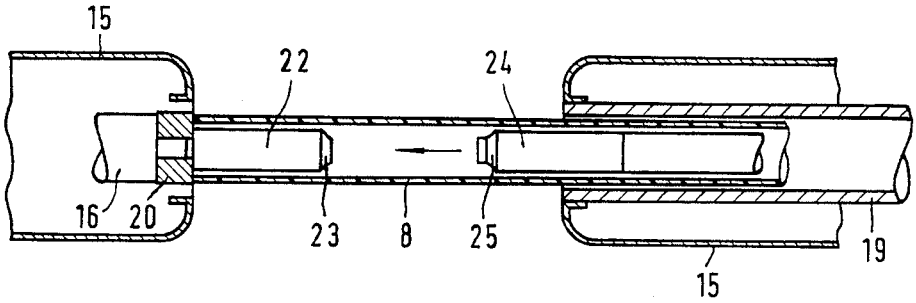
FIG. 6 is a view similar to FIG. 5 but showing the switch intermediate the open and closed positions.
Figure 7:
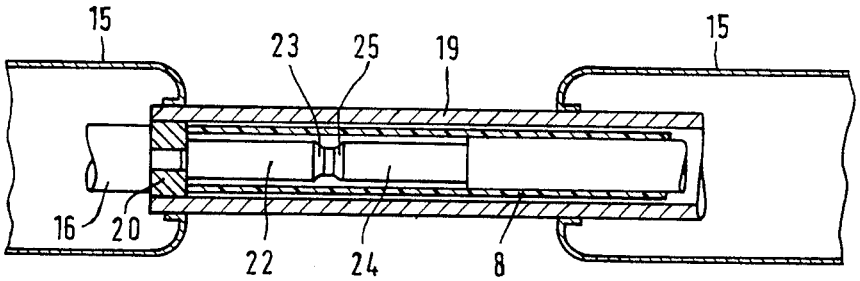
FIG. 7 is a view similar to FIG. 6 but showing the switch in the closed-circuit position.

Referring to the drawings, FIGS. 1–4 show a first model and FIGS. 5–7 show a second, modified example. Only the parts necessary for the understanding of the invention are shown without the metal encapsulation. The same reference numbers are valid in both diagrams.

Referring to FIGS. 1–4, a high voltage disconnect switch is shown which is metal-clad and insulated by SF6 pressurized gas. The switch has two coaxially opposing cylindrical contact assemblies comprising field electrodes. Between these is the isolation space of contact gap 3, indicated by arrows. On the inside of the right hand, hollow, cylindrical contact assembly 2 is arranged a contact tube 4, which is connected galvanically over a sliding contact 5 with the contact assembly 2 and thus has the same potential. Contact tube 4 serves as a movable contact element. On its face it is provided with a lip 6 which touches the opposing contact assembly 1 inside the rim 7 in the "closed" or "on" position.

The contact assembly 1 is provided with an isolating tube 8, preferably with ribs on its surface for the prevention of sliding sparks. The O.D. of the ribs 9 is smaller than the diameter of the rim 7 in the opening of the contact assembly 1. Two rod-like resistances 10 are positioned along the longitudinal axis of contact assemblies 1 and 2. The resistances are low inductance and anti-capacitive and have a ceramic carrier with a good thermal conductivity, e.g. $Al_2O_3$ into which the resistance is baked by a suitable method. The faces 11 of the resistances are provided with massive metal contacts. The O.D. of the resistances is smaller than the I.D. of the isolating tube 8.

Figure 1:
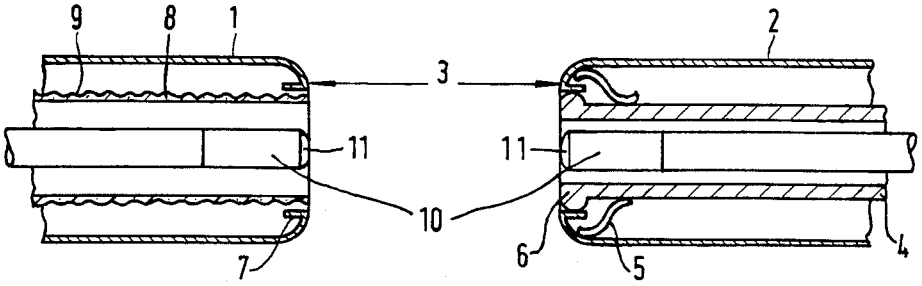
FIG. 1 is a diagrammatic longitudinal cross-sectional view of an embodiment of a disconnect switch in the open-circuit position.

FIG. 1 shows the "open" or "off" position of the disconnect switch. In this position neither the isolating tube 8 nor the one resistance 10 inside the contact assembly protrude from the face of the contact assembly on the left. The same is the case for the contact assembly 2 on the right, on the inside of which are positioned resistance 10 and contact tube 4. The electrical field inside contact gap 3 depends therefore on the form of the contact assemblies 1, 2 and will not be disturbed by the parts located inside.

Figure 2:
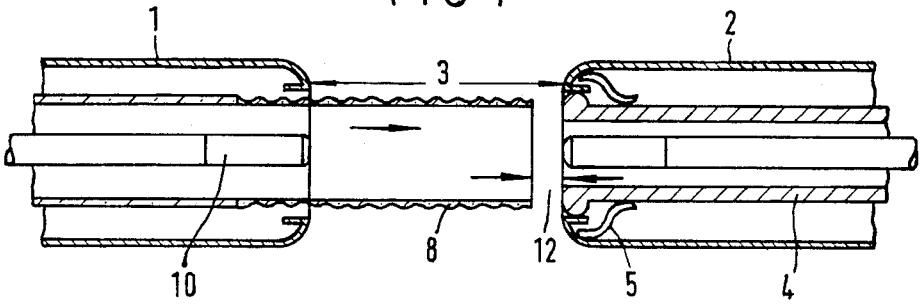
FIG. 2 is a view similar to FIG. 1 but showing the switch as it switches from the open-circuit position to the closed-circuit position.

The start of the "on" movement is shown in FIG. 2. By means of a drive, not shown here, the isolating tube 8 is moved out of the left contact assembly 1 into isolation space or the contact gap 3 until it reaches an end position within distance 12 to the opposite contact assembly 2, shown by arrows at 12. This distance 12 is selected in such a way that no sliding sparks can develop on the surface of the isolating tube 8. As shown in FIG. 3, the two resistances 10 are now moved into the contact gap 3 from both sides, symmetrically, by their own drives, (not shown). In this way, the remaining contact gap 13 between their faces will remain in the center of the contact gap 3. When partial contact gap 13 becomes sufficiently small, an arc occurs between the two resistances 10. As this arc burns inside isolating tube 8, which protrudes at a sufficient distance, the arc travelling to the encapsulation is rendered impossible, since the isolating tube screens the arc. In addition, no high frequency oscillations can originate at re-ignition of the arc because of the symmetrical damping effect of the resistances 10.

FIG. 4 shows the "on" position of the disconnect switch, where the two resistances 10 are in contact with each other over their faces 11 and the contact tube 4 has moved into the contact gap 3 by means of its own drive (not shown) and has pushed back isolating tube 8 into the inside of contact maker 1. Contact tube 4 is engaged through its lip 6 with the rim 7 of the contact assembly 1 in such a way that a conductive connection exists between the two contact assemblies 1 and 2. The heat generated thereby can now be dissipated freely to the outside by the metallic contact tube 4.

When the disconnect switch opens, the movement of all parts occurs in reverse. First, the contact tube 4 is pulled into the inside of contact assembly 2 and the isolating tube 8 exits into the contact gap 3 to bridge it up to distance 12. Both resistances 10 are removed symmetrically from the contact gap 3 by their own drives and, finally, when the resistances 10 are in their rest positions, the isolating tube moves out of the contact gap 3 until it reaches its own rest position on the inside of contact assembly 1.

For solving the problem of high frequency resonance oscillation, the invention is based on: a disconnect switch for a metal-clad, pressurized-gas isolated, high-voltage switchgear installation with two cylindrical contact pieces, surrounded by field electrodes, and which are touching each other in the "closed" position, for which purpose during switching at least one of the contact pieces is moving on a longitudinal axis common to both contact pieces. Inside of the field electrode is a movable isolating tube for the purpose of bridging the contact gap between the contact pieces for essentially as long a time as the contact pieces are in motion. This disconnect switch, consistent with the invention, is constructed in such a way that on a longitudinal axis are arranged two movable resistances, of approximately the same size, electrically connected to the contact pieces, with their outside dimensions smaller than the inside diameter of the isolating tube; and which, at the start of the switching movement are introduced into the contact gap and which will bridge over the contact gap after the isolating tube has at least bridged the gap sufficiently and before the opposing contact pieces or the field electrodes are touching each other.

This arrangement creates the condition wherein an arc can only occur between the resistances having different potentials. Due to the damping effect of the resistances, the generation of high frequency oscillations will be prevented. Apart from that, the arc cannot travel to the encapsulation and cannot cause a ground short circuit, because the arc is screened by the isolating tube, which covers the isolation space or contact gap widely. As a result of applying two nearly equally large resistances, the arc burns approximately in the center of the contact gap between the field electrodes. By this means, a minimum of capacitive coupling to both conductor ends, and a symmetrical suppression of high frequency oscillations is obtained.

It is preferred that the resistances be designed to have low induction and to be anti-capacitive. They should have a ceramic carrier with good thermal conductivity and massive metal contacts, since they are exposed to the arcing effects and the heat increase connected therewith. It would be appropriate to make the metal contacts on the face of at least one of the resistances, which face each other, resilient, so as to avoid bumping stresses on the resistances during switching. Neither lifetime nor efficiency should be affected by the arcs.

The level of the resistance value will be determined by the self-capacitance of the conductors to be disconnected, the operating voltage and the frequency of the net work. It would be additionally helpful if the voltage drop at the resistances caused by reactive currents do not exceed 1 to 2% of the operating voltage, because otherwise on bridging of the dampening resistances voltage pulses occur again.

Furthermore, it is appropriate to arrange one of the resistances in each of the opposing field electrodes of the disconnect switch and to guide them, with the help of an individual drive mechanism, symmetrically into the contact gap, when the isolating tube has arrived at its end position, leaving a gap to the opposing field electrode. In this way, the remaining part of the contact gap between the two resistances is always centered between the two electrodes.

Additionally, the generation of sliding sparks on the surface of the isolating tube is avoided because the tube does not come into contact with the opposing field electrode. However, other means of preventing the generation of sliding sparks could be applied, e.g. if the isolating tube is made of a high resistance semiconductor, or if ribs are provided on its surface.

Referring to FIG. 5, a different embodiment of a disconnect switch for a metal-clad, pressurized-gas insulated, high-voltage switchgear installation is shown. Here there is a cylindrical contact 16, surround by a field electrode 15. On its face 17 the contact carries an extension 18 running flush with the face of the field electrode 15. Opposite, there is another field electrode 15, which surrounds the movable contact maker 19. This movable contact maker 19 is pipe-shaped and, when in the "on" position, is in galvanic contact with the opposite field electrode 15. Inside the pipe-shaped contact maker 19, an isolating tube 8 is arranged, which has its own drive. The high resistance, semiconducting isolating tube 8 is provided, on its face opposite the contact gap 3, with a metal contact 20 with a center opening 21. In the "on" position, this contact 20 makes the connection to contact maker 16 with its extension 18. Contact 20 is connected to one side of a resistance 22 which has at its other end another metal contact 23. This resistance rests firmly inside the isolating tube 8 and moves with it.

An equal-sized resistance 24 is arranged inside isolating tube 8, and has resilient metal contact on its face toward the contact gap 3. Its opposite end is connected to a drive, (not shown). The O.D.s of resistances 22,24 respectively, are smaller than the I.D. of the isolating tube 8.

FIG. 5 shows the "off" position of the disconnect switch, i.e. the movable pipe-shaped contact maker 19 is located inside of the field electrode 15 together with the two resistances 22 and 24 and the isolating tube 8. At the start of the switching movement, first the isolating tube 8 is moved by its own drive (not shown) into the contact gap 3. It takes with it the first resistance 22, which is rigidly connected, to the point at which electrical contact takes place between metal contact 20 and the stationary contact 16. In this way, resistance 22 and the stationary contact 16 are electrically connected and have the same potential. The total length of the contact gap 3 in this position is bridged by the isolating tube 8. Following this, the second resistance 24, on the inside of isolating tube 8 is moved by its own drive into the contact gap 3. This condition is shown on FIG. 6 of the diagrams.

As soon as the distance between resilient metal contact 25 of resistance 24 and metal contact 23 of resistance 22 is close enough, an arc can originate between the two. This arc, however, is maintained between the resistances, and in addition, the isolating tube 8 will prevent its travelling to the encapsulation. After the two resistances 22 and 24 are in contact with each other, the contact gap 3 is bridged by the movable contact maker 19, driven by its own drive, and contact is established with the opposite field electrode 15. The motion of the isolating tube 8, together with its resistance 22, can be relatively slow at the "turning on" motion. Resistance 24, however, should move faster in order to avoid a capacitive bridging between resistance 24 and the contact maker 19. FIG. 7 shows the end position of the closed disconnect switch.

At the opening of the disconnect switch, the movement of the various parts takes place in the reverse sequence. First, the movable contact maker 19, is pulled back into its original position on the inside of the field electrode 15. Then resistance 24 inside of the isolating tube 8 is likewise returned to its original position. Finally, the isolating tube 8, along with resistance 22, are removed from the contact gap.

Thus, the arc is encouraged to travel between the resistances within the isolating tube. To prevent generation of high frequency oscillations during an arc, the two resistances, movable and of equal size, which are electrically connected to the contacts, are moved into the contact gap at the start of the switching operation and sufficiently bridge the gap through the isolating tube before the contacts touch. The arc is therefore triggered through the resistances only.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true spirit and script of the invention.

What is claimed is new and desired to be secured by Letters Patent of the United States:

1. A disconnect switch for a metal-clad, pressurized-gas insulated, high voltage switchgear installation, comprising:

a first and a second cylindrical contact having a common longitudinal axis and being switchable between an open position at which said contacts define an isolation space and a closed position at which said contacts are in electrical contact, at least one of said contacts being movable along said axis between said open position and said closed position, an isolating tube positioned inside of one of said contacts and movable along said axis during switching toward and from the other of said contacts, said isolating tube bridging the isolation space between said contacts as long as one of the contacts is moved, a first and a second resistance positioned and movable on said axis during switching, each resistance being of approximately the same size, electrically connected or connectable to one of the contacts, said first and second resistance having external dimensions which are smaller than the internal diameter of said isolating tube, said resistances being introduced into the isolation space at the start of the switching operation bridging said isolation space after the at least sufficient bridging of the isolations space by the isolating tube before said opposed first and second contacts come into contact with each other.

2. A disconnect switch according to claim 1, wherein the resistances are constructed to be of low inductance and of low capacity.

3. A disconnect switch according to claim 1, wherein each resistance is provided on a good thermally conductive ceramic carrier.

4. A disconnect switch according to claim 1, wherein the resistances are, at least on one of their faces opposite each other, equipped with metal contacts of resilient construction.

5. A disconnect switch according to claim 1, wherein each resistance is moved symmetrically into the isolation space when the isolating tube has reached its end position in the isolation space and leaves a preselected distance to the opposite contact.

6. A disconnect switch, in accordance with claim 5, wherein on the return movement of the movable contact the isolating tube is brought back into its final position in the isolation space before the return of the resistances starts.

7. A disconnect switch, in accordance with claim 1, wherein the isolating tube is equipped with ribs.

8. A disconnect switch, in accordance with claim 1, wherein the isolating tube is of very high resistance and semiconductive.

9. A disconnect switch, in accordance with claim 1, in which each cylindrical contact comprises or is arranged in a respective field electrode.

10. A disconnect switch for a metal-clad, pressurized-gas insulated, high-voltage switchgear installation, comprising:

first and second cylindrical contacts having a common longitudinal axis and being switchable between an open position at which said contacts define an isolation space and a closed position at which said contacts are in electrical contact;

an isolating tube positioned inside said first contact and movable along said axis during switching toward and from said second contact;

a contact element postioned within said second contact and movable therein along said second contact and movable therein along said axis during switching between an open position at which said contact element is completely within said second contact and a closed position at which said contact element engages said first contact;

a first resistance positioned within the said isolating tube and movable along said axis inside said isolating tube during switching toward and from said second contact and a second resistance positioned within said contact element and movable along said axis during switching toward and from said first contact, said first and second resistances making electrical contact before said first contact and said electrical contact element make electrical contact and breaking electrical contact after said first contact and said electrical contact element break electrical contact.

11. A disconnect switch according to claim 10, wherein the resistances are constructed to be of low inductance and of low capacity.

12. A disconnect switch according to claim 10, wherein each resistance is provided on a good thermally conductive ceramic carrier.

13. A disconnect switch according to claim 10, wherein the resistances ar, at least on one of their faces opposite each other, equipped with metal contacts of resilient construction.

14. A disconnect switch, as set forth in claim 10, wherein each of the first and second resistances is moved symmetrically into the isolation space between the first and second contact when the isolating tube has reached its end position toward the second contact.

15. A disconnect switch, as set forth in claim 10, wherein said contact element pushes the isolating tube from the isolation space toward the first contact.

16. A disconnect switch, as set forth in claim 10, wherein the isolating tube is moved toward said second contact before said first and second resistances are retracted to their open positions within the first and second contact assemblies respectively.

17. A disconnect switch, in accordance with claim 10, in which each cylindrical contact comprises or is arranged in a respective field electrode.

18. A disconnect switch, as set forth in claim 10, wherein the isolating tube is provided with ribs on its surface.

19. A disconnect switch for a metal-clad, pressurized-gas insulated, high-voltage switchgear installation, comprising:

first and second contact having a common longitudinal axis and being switchable between an open position at which said contact define there between an isolation space and a closed position at which the contacts are in electrical contact;

a contact element positioned within one of said first and second contacts and movable therein along said axis during switching between an open position at which said contact element is completely within said contact and a closed position at which said contact element engages said opposite contact;

an isolating tube positioned inside one of said first and second contacts and inside said contact element and movable therein along said axis during switching between an open position at which said contact element is completely within said one of said contacts and a closed position at which said contact element engages the other of said contacts; and first and second resistances positioned with said isolating tube and movable along said axis inside said isolating tube during switching toward and from the other of said contacts.

20. A disconnect switch, as set forth in claim 19, wherein the isolating tube has a face with a metal contact.

21. A disconnect switch, as set forth in claim 19, in which the one of said first and second contacts which does not contain the isolating tube comprises a field electrode including an electrical contact having an axtension.

22. A disconnectect switch, as set forth in claim 19 including:

a metal contact positioned on the face of the isolating tube;

an electrical contact having an extension and being positoned in the other said first and second contacts; and a metal contact positioned on said extension, said metal contacts contact ohne another at the closed position of the first and second contacts.

23. A disconnect switch, as set forth in claim 19, wherein during switching from the open position to the closed position, the isolating tube and first resistance move toward the other of said contact assemblies creating a gap between the first and second resistances, said second resistance moving in the tube closing the gap after said first resistance makes electrical contact with the other of said contacts.

24. A disconnect switch, as set forth in claim 19, wherein during switching from the closed position to the open position, the second resistance retracts creating a gap between the first and second resistances before the first resistance and isolating tube retract.

25. A disconnect switch, as set forth in claim 19, wherein the isolating tube and first resistance move in concert.

26. A disconnect switch, as set forth in claim 19, wherein the isolating tube is semi-conductive of high resistance.

27. A disconnect switch, as set forth in claim 19, wherein the one of said first or second contacts which contains the isolating tube is surrounded by a field electrode.

* * * * *

UNITED STATES PATENT AND TRADEMARK OFFICE

CERTIFICATE OF CORRECTION

PATENT NO. : 4,539,448

DATED : September 3, 1985

INVENTOR(S) : Winfried Schulz

It is certified that error appears in the above-identified patent and that said Letters Patent are hereby corrected as shown below:

Column 1 line 23, cancel "ist" and insert --is--.
Column 1 line 24, cancel "mowement" and insert --movement--.
Column 1 line 52, cancel "ist" and insert --is--.
Column 2 line 3, cancel "concernes" and insert --concerns--.
Column 2 line 39, after "isolation"(2nd occurr) s/b --space--.
Column 2 line 55, cancel "accur" and insert --occur--.
Column 7 line 68, after "contact" insert --;--.
Column 8 line 16, cancel "ar" and insert --are--.
Column 9 line 3, cancel "axtension" and insert --extension--.
Column 9 line 12, cancel "ohne" and insert --one--.

Signed and Sealed this

*Fifth* Day of *November 1985*

[SEAL]

*Attest:*

*Attesting Officer*

DONALD J. QUIGG

*Commissioner of Patents and Trademarks*